United States Patent [19]

Venable et al.

[11] 4,239,085

[45] Dec. 16, 1980

[54] SIDE SHIFT ASSEMBLY FOR EARTH-WORKING IMPLEMENTS

[75] Inventors: Phillip G. Venable, Orion, Ill.; Rudolf Horsch, Davenport, Iowa

[73] Assignee: J. I. Case Company, Racine, Wis.

[21] Appl. No.: 57,769

[22] Filed: Jul. 16, 1979

[51] Int. Cl.[3] ..... E02F 3/85

[52] U.S. Cl. ..... 172/667; 414/695; 280/456 R

[58] Field of Search ..... 172/667, 477; 414/694, 414/695; 280/456 R, 456 A, 479; 37/103, 118

[56] References Cited

U.S. PATENT DOCUMENTS

| | | | |
|---|---|---|---|
| 3,155,250 | 11/1964 | French | 414/695 |
| 3,571,956 | 3/1971 | Heiberg | 172/477 |
| 3,993,206 | 11/1976 | Jomen | 414/695 |
| 4,020,745 | 5/1977 | Iijima | 414/695 |
| 4,113,031 | 9/1978 | Venable | 172/667 |

*Primary Examiner*—Richard J. Johnson

*Attorney, Agent, or Firm*—Cullen, Sloman, Cantor, Grauer, Scott & Rutherford

[57] ABSTRACT

An implement side shift assembly is disclosed for laterally shifting an earth-working implement relative to a tractor or the like. The side shift mechanism permits various implement attachments to be mounted on one common side shift frame. The side shift assembly includes a frame assembly having laterally extending upper and lower slide rails. An implement support bracket mounts the implement to the slide rails for lateral movement. A slide plate is slidably mounted between the slide rails for lateral movement, and a piston-cylinder is connected between the frame assembly and slide plate to move the slide plate laterally. A latching mechanism selectively connects the slide plate to the implement support bracket at one of a plurality of connecting points on the implement support bracket. One of the points of connection between the slide plate and implement support bracket permits lateral shifting of the implement by the piston-cylinder from the center of the frame assembly to the left and back to center while another point of connection permits shifting from the center of the frame assembly to the right and back to center. The side shift assembly permits the implement attachment to be moved laterally twice as far as the piston stroke. The latching mechanism for latching the slide plate to the implement support bracket is accessible to the operator and is capable of being unlatched regardless of the position of the implement or automatically tripped for relatching the slide plate to the implement support bracket as may be desired.

13 Claims, 10 Drawing Figures

20
21
22
23
24
26
27
28
29
30
32
34
36
38
42
44
56
57
58
62
64
65
68
70
72
74
76
78
79
80
82
83
84
86
88
89
94
98
102
103
106
128
130

SIDE SHIFT ASSEMBLY FOR EARTH-WORKING IMPLEMENTS

BACKGROUND OF THE INVENTION

The present invention relates to side shift mechanisms for earth-working implements, particularly vertical plows, cable laying plows, trenchers and the like. More particularly, the present invention relates to improvements in power side shift mechanisms wherein any one of a plurality of different implement attachments may be mounted on one common side shift frame.

The prior art discloses a number of side shift mechanisms which are powered by fluid operated piston-cylinders and more complex drive systems, such as rack and pinion devices, etc. The prior art has several disadvantages. For impositive drive systems, the lateral shift of the implement is normally limited by the length and stroke of the piston cylinder, and where a relatively large piston-cylinder is utilized, the piston-cylinder is expensive. Positive drive systems are relatively complex, expensive, and subject to mechanical failure, particularly in earth-working environments.

Another problem with the prior art devices is that they are typically limited for use with one implement only. Thus, each implement attachment has its own side shift mechanism which is undesirable economically and means that substantial time and effort must be expended to make any changeovers.

A power shift mechanism for earth-working implements which eliminates many of the problems of the prior art is disclosed in U.S. Pat. No. 4,113,031 to Venable assigned to the assignee of the present invention. The present invention is an improvement over U.S. Pat. No. 4,113,031 because it utilizes a laterally slidable plate in combination with a latching mechanism as described hereinbelow which permits various earth-working implements to be mounted on one common side shift frame with a relatively quick method for mounting or removing the attachments.

SUMMARY OF THE INVENTION

The side shift mechanism of the present invention is particularly adapted to laterally shift a vertical plow, cable plow, or other earth-working implement mounted on a prime mover. In the disclosed embodiment, the prime mover includes a support frame assembly, and the implement is mounted on a support bracket which is slidably supported on the frame assembly. The earth-working implement may be shifted laterally relative to the prime mover by laterally shifting the implement support bracket.

In the preferred embodiment, the support frame assembly includes laterally extending upper and lower slide rails which are connected by vertical support masts to form a generally rectangular frame. Each implement to be attached on the frame assembly includes upper and lower support brackets which mount the implement on the slide rails for lateral movement of the implement relative to the prime mover. The support brackets have hook-like mounting portions which capture the upper and lower slide rails of the frame assembly while providing sufficient clearance to permit the implement to slide horizontally on the support frame assembly.

The hook-like mounting portions are removable from the support brackets, and removal of one hook mount permits removal of the implement from the frame assembly. Thus, it can be seen that the frame assembly and implement support bracket arrangement permits various earth-working implements such as cable plow and trencher attachments to be mounted on one common side shift frame with a relatively quick method for mounting or removing the attachments.

An important feature of the present invention resides in the intermediate slide plate which is slidably mounted between the slide rails of the frame assembly for lateral movement. A piston-cylinder is connected between the frame assembly and the slide plate to move the slide plate laterally along the slide rails. A latching mechanism mounted on the slide plate selectively connects the slide plate to one of the implement support brackets at one of a plurality of connecting points on the implement support bracket.

By connecting the slide plate to various connecting points on the implement support bracket, the piston-cylinder is capable of fully laterally shifting the implement while reducing the length and stroke requirements of the piston-cylinder. In the disclosed embodiment, the stroke of the piston-cylinder may be approximately one-half the lateral shift of the implement, substantially reducing the power requirements and the expense of the piston-cylinder.

The latching mechanism includes a spring-biased cantilevered pin which passes through an opening in the slide plate to mate with an aligned opening in the implement support bracket. When the piston-cylinder is fully retracted, the opening in the slide plate is one-half the distance of the cylinder stroke to the left of the center of the side shift frame assembly. When the cylinder is fully extended, the opening in the slide plate is an equal distance to the right of the center of the frame assembly. Mating openings are provided in the implement support bracket so that when the slide plate is latched to the implement support bracket and the piston-cylinder is extended or retracted, the slide plate, implement support bracket, and implement attachment are moved laterally.

The distance between the mating openings in the implement support bracket is equal to the piston-cylinder stroke. The slide plate includes a stop block mounted thereon which moves between and abuts stops mounted on the upper implement support bracket. The stop block on the slide plate and stops on the upper support bracket insure proper alignment between the opening in the slide plate and the selected mating opening in the implement support bracket.

If the piston-cylinder is fully retracted and the implement is centered on the frame assembly, the opening in the slide plate will be aligned with one of the mating openings in the implement support bracket thereby permitting the cantilevered pin to latch the slide plate to the support bracket in a first latched condition. Actuation of the piston-cylinder will move the implement to the right on the frame assembly and back to center. When the piston-cylinder is extended and the implement attachment is centered on the frame assembly, the opening in the slide plate is aligned with another mating opening in the implement support bracket and the slide plate may again be latched to the implement support bracket by the cantilevered latch pin. Actuation of the piston-cylinder under this second latched conditon moves the slide plate and attached implement laterally to the left and back to center.

There are numerous advantages provided by the intermediate slide plate of the present invention. The slide plate provides a relatively flat surface which permits the mounting of a variety of implement attachments on one common side shift frame. By providing spaced apart openings in the implement support bracket, the slide plate may be latched to the implement at a plurality of positions which permits the stroke of the piston-cylinder to be reduced thereby reducing the expense of the piston-cylinder. The implements attached to the side shift frame may be changed with relative ease by merely removing the hook-like mounting portions secured to the implement support brackets. Other advantages in the intermediate slide plate are further disclosed herein.

Another part of the present invention resides in the latching mechanism which connects the slide plate to the implement support bracket and which is designed to be accessible from an operator's station regardless of the position of the cantilevered latch pin or the implement. The latch pin which forms part of the latching mechanism is mounted to the slide plate for slidable movement through the opening in the slide plate, and it is spring-biased so that it normally extends through the slide plate opening in a cantilevered fashion. The latch pin mates within a selected mating opening in the implement support bracket when it is desired to side shift the implement.

The latching mechanism further includes a control rod which is mounted by brackets on the frame assembly, for slidable movement, and the rod is movable by a control lever which is connected at one end of the control rod and accessible to an operator. A cam is slidably mounted on the control rod and movable along its longitudinal extent. The cam is movable along the control rod between stop washers which are fixed to the control rod. The cam engages a portion of the latch pin to retract the latch pin from latching engagement with the implement support bracket opening or permit the latch pin to be spring-biased into locking engagement with the implement support bracket opening.

The cam includes a cam surface having a generally V-shaped portion and adjoining flat portions. The latch pin includes a roll-pin which is transverse to its longitudinal axis and which engages the cam surface of the cam.

When it is desired to side shift the implement, the roll-pin portion of the latch pin must be in the notch of the V-shaped cam surface portion which permits the latch pin to be spring-biased into locking engagement with one of the openings in the implement support bracket. To unlatch the pin, the operator pivots the control lever which, in turn, linearly moves the control rod and one of the stop washers against the side of the cam. As the cam is forced to move with the control rod, the roll pin slides up the V-shaped cam portion and onto one of the flat portions of the cam surface. This permits the piston-cylinder to actuate the slide plate, cam, and latch pin laterally. When the piston-cylinder is fully extended, the cam contacts another stop washer which stops the cam and permits the spring-biased latch pin to be automatically tripped off the flat of the cam surface and back into the notch of the V-shaped cam portion, thereby relatching the pin with the implement support bracket.

The latching mechanism design provides the advantages of a control lever position accessible to the operator, a positive unlatching mechanism for the latch pin, and an automatic trip mechanism for relatching the latch pin which eliminates the possibility of cable, hydraulic hose or other structure getting caught during the side shift function.

Other advantages and meritorious features of the side shift mechanism will be more fully understood from the following description of the preferred embodiment, the appended claims, and the drawings, a brief description of which follows.

DETAILED DESCRIPTION OF THE INVENTION

Figures 1, 2:
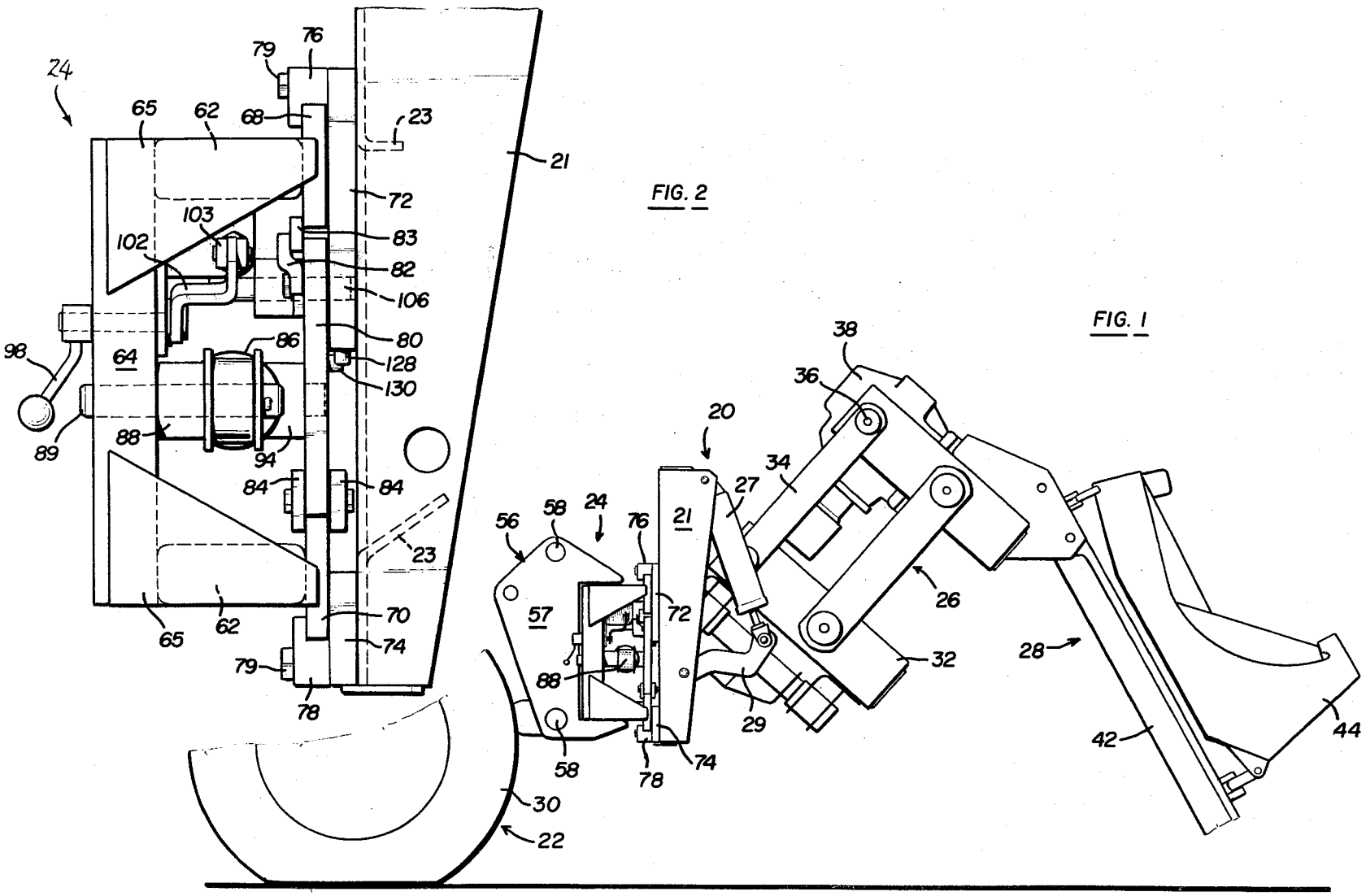
FIG. 1 is a partial side view of a cable laying plow mounted on the side shift assembly of the present invention.
FIG. 2 is an exploded side view of the side shift mechanism of the present invention.
Figure 3:
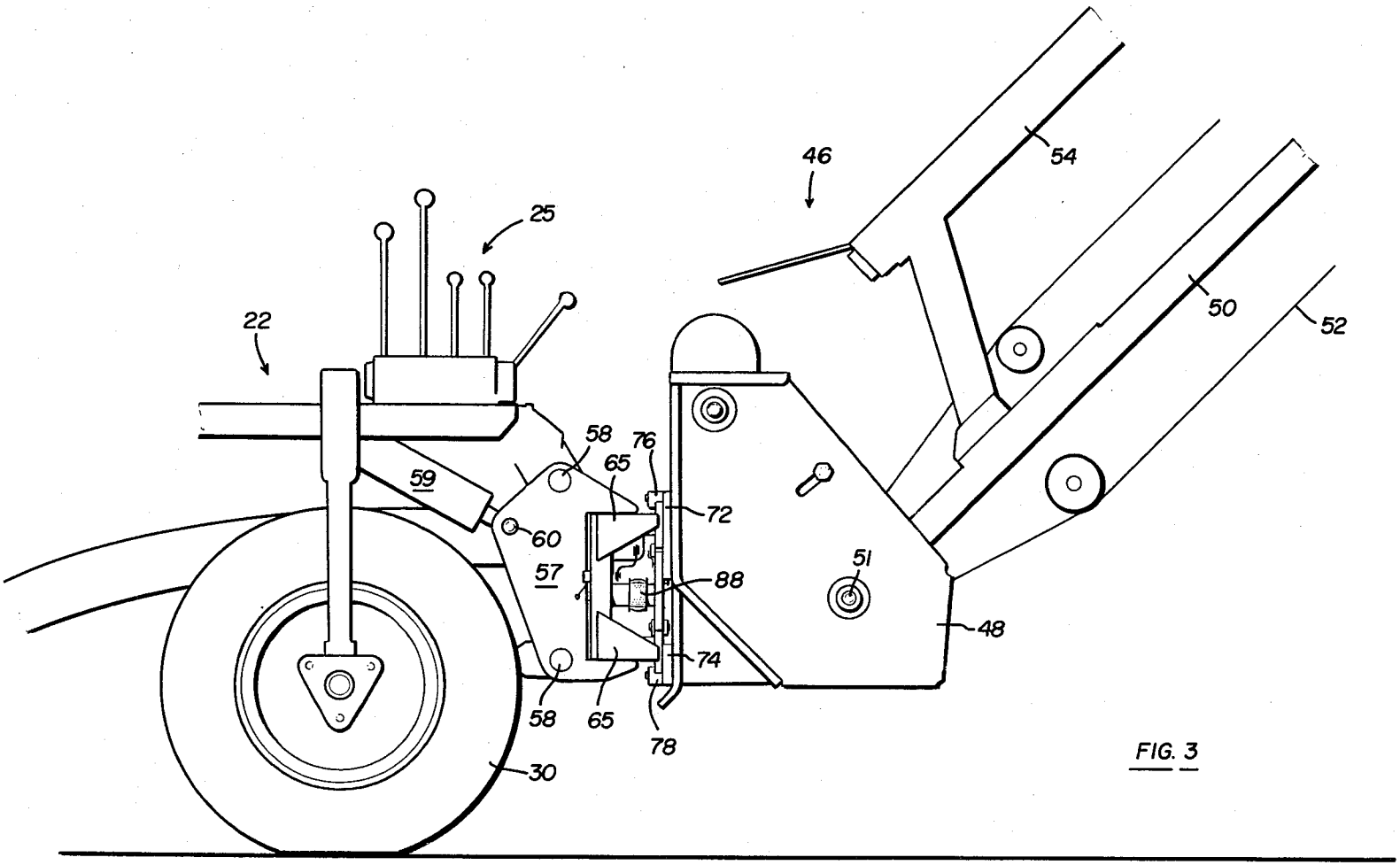
FIG. 3 is a partial side view of a trenching attachment mounted on the side shift assembly.

FIGS. 1 and 3 illustrate earth-working implements mounted on the side shift assembly of the present invention. It will be understood that the side shift mechanism may be used for various implements, including side shift backhoes and the like. The cable plow 20 shown in FIG. 1 includes a prime mover 22, a side shift mechanism 24, a plow frame assembly 26, and a plow assembly 28. In the disclosed embodiment, the prime mover 22 is a conventional tractor having wheels 30. It will be understod however that various prime movers may be used, including bulldozers and the like.

The disclosed embodiment of the cable plow 20 includes a vibration isolating frame assembly 26. The frame assembly includes vertical and horizontal frame members 32 and 44, respectively, interconnected by resilient torsional bushings 36. A vibrator or shaker 38 is supported on the plow frame assembly 26 which vertically vibrates the generally vertical blade 42 of the plow assembly. The disclosed embodiment of the cable plow includes a multiple cable chute 44 on the trailing edge of the blade 42.

FIG. 3 discloses a trenching attachment 46 which is attached to the side shift assembly 24. The trencher 46 includes a frame assembly 48, a digging boom 50 pivotally connected to the frame assembly by pivot shaft 51, a digging chain 52 entrained around the digging boom 50, operator's controls 25, and a crumber 54. It will be understood that the details of the prime mover 22, the plow frame assembly 26, the plow assembly 28, and the trencher 46 are not critical to the side shift mechanism of the present invention and therefore have not been disclosed in detail herein.

The side shift mechanism 24 of the present is mounted to the prime mover 22 by frame assembly 56 as illustrated in FIGS. 1 and 3. The frame assembly 56 includes vertical side plates 57 and 61 (FIG. 4) which are welded or otherwise secured to the side shift mechanism 24. Frame assembly 56 is secured to prime mover 22 by pivot pins 58 and a piston-cylinder 59 which is connected at its rod end between side plates 57, 61 by pin connection 60.

Figure 4:
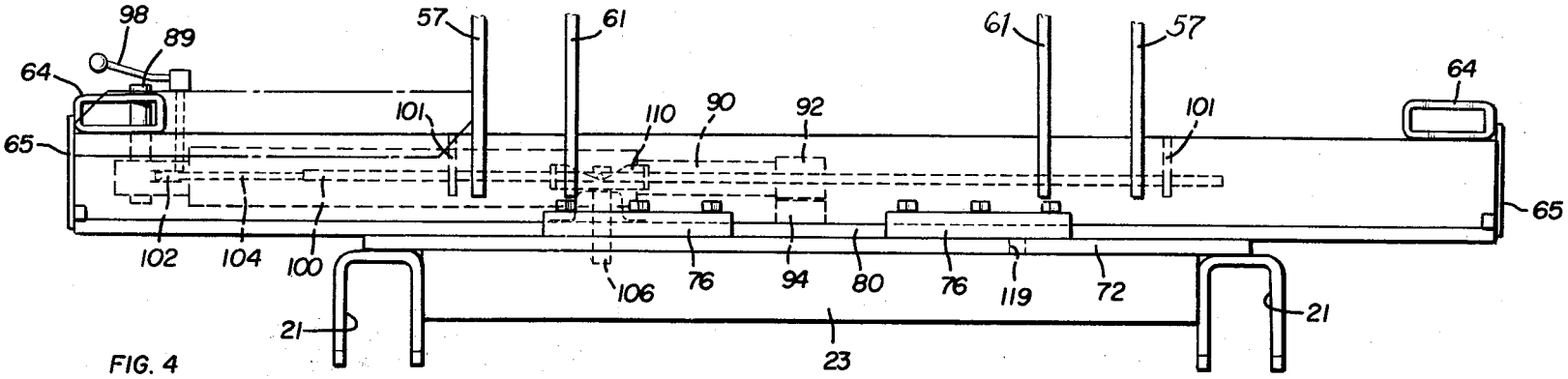
FIG. 4 is a top plan view of the side shift mechanism and illustrating the implement support brackets, slide plate, and latching mechanism.
Figure 5:
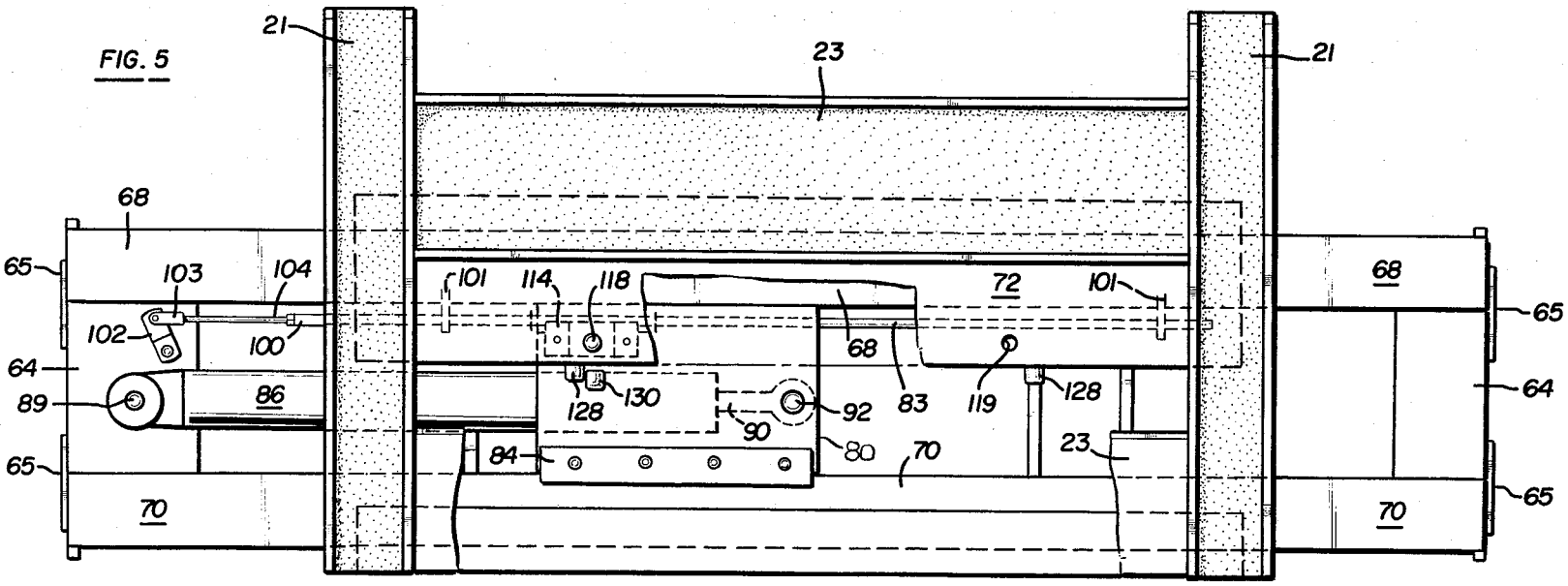
FIG. 5 is a rear view of the side shift mechanism illustrated in FIG. 4.

Referring to FIGS. 2, 4 and 5, the side shift assembly 24 of the present invention includes a generally rectangular frame assembly including upper and lower gusset tubes 62, vertical tube members 64, and gusset plates 65. As illustrated in FIG. 2, the horizontal gusset tubes 62 are welded to the vertical tube members 64, and the gusset plates 65 are welded to the ends thereof. Upper and lower slide rails 68 and 70 are welded or otherwise secured to the forward ends of the gusset tubes 62. The slide rails 68 and 70 are rectangular in cross section and form guides on which the implement attachment may be laterally shifted.

The implement mounting structure for the cable plow is illustrated in FIGS. 2, 4, and 5. It includes vertical frame members 21 interconnected by horizontal support members 23 to form a rectangular frame for supporting the cable plow assembly 26. Lift cylinders 27 (FIG. 1) and lift arms 29 are mounted to the vertical frame members 21 and to the plow assembly 26 to raise and lower the vertical plow 42. Each implement attachment has secured thereto an upper support bracket 72 and a lower support bracket 74. Removable hook-like keeper bars 76 and 78 are suitably mounted to the implement support brackets 72 and 74 such as by bolts 79.

The side shift frame assembly including the upper and lower slide rails 68 and 70, the upper and lower implement support brackets 72 and 74, and the hook-like keeper 76 and 78 permit several implement attachments to be mounted on one common side shift frame including the cable plow 26 and trencher 46 illustrated in FIGS. 1 and 3. The hook-like keeper bars 76 and 78 capture the upper and lower slide rails 68 and 70 and thereby support the implement attachment for lateral shifting. There is provided enough clearance between the bars 76 and 78 and side rails to permit the implement attachment to slide horizontally on the side shift frame assembly. To remove the implement attachment, it is only necessary to remove the lower keeper bar 78 and lift the implement off the upper slide rail 68. This provides a relatively quick method of mounting and demounting the implement attachments.

An important feature of the present invention resides in the intermediate slide plate 80 which is captured between and slidable along the upper and lower slide rails 68 and 70. The slide plate 80 is slidably secured at its upper end by slide retainer 82 secured to the slide plate and bar 83 secured to upper slide rail 68. The lower end of intermediate slide plate 80 is slidably secured to lower slide rail 70 by opposed guide bars 84 as illustrated in FIG. 2. Referring to FIGS. 2, 4 and 5, a side shift piston-cylinder 86 is connected at its cylinder end by bushing assembly 88 and cylinder pin 89 to vertical frame member 64. The piston rod 90 is connected to slide plate 80 by cylinder pin 92 and bushing 94. Extension and retraction of the side shift piston-cylinder 86 causes the slide plate 80 to shift laterally along slide rails 68 and 70.

Figure 10:
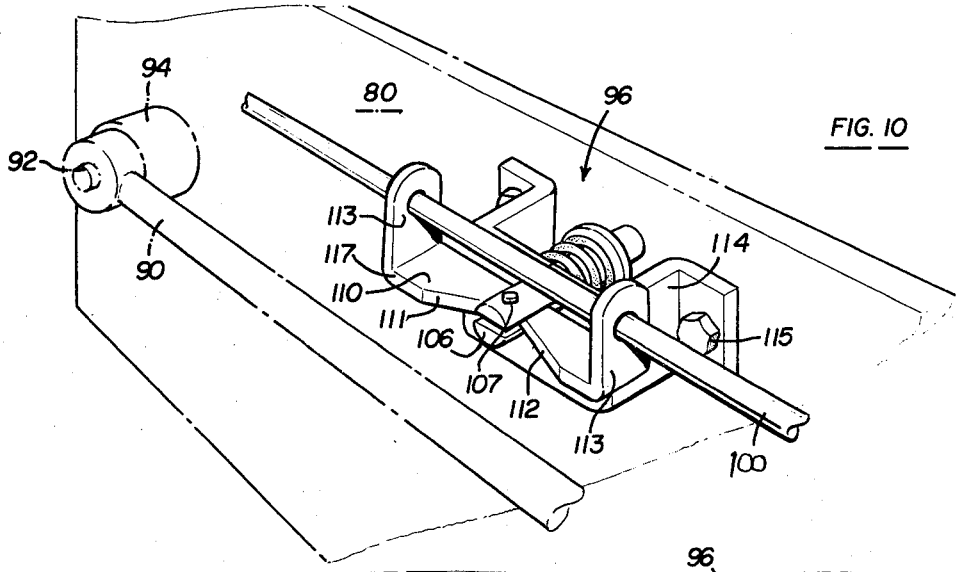
FIG. 10 is a perspective view of the spring-biased latch pin, its mounting bracket, and the cam which permits the latch pin to be latched and unlatched.
Figure 9:
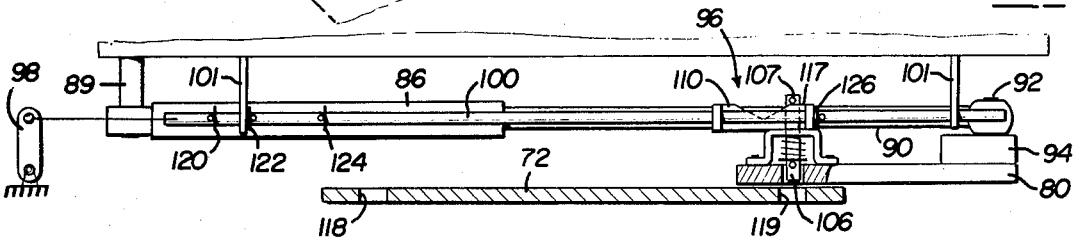
FIG. 9 is a detailed top plan view of the latching mechanism illustrating the unlatching of the latch pin from its position illustrated in FIG. 8.

Referring to FIG. 10, a latching mechanism 96 is partially disclosed for locking the slide plate 80 to the upper implement support bracket 72. The latching mechanism 96 is controlled by an operator's control lever 98 which is illustrated in FIGS. 2 and 4. The latching mechanism selectively connects the slide plate 80 to the upper implement support bracket 72 at one of a plurality of connecting points on the implement support bracket.

Referring to FIGS. 5–9, the latching mechanism further includes a control rod 100 which is slidable within brackets 101 which are secured to upper gusset tube 62. The operator's control lever 98 is connected to one end of control rod 100 by latch lever 102 (FIG. 2). The latch lever 102 translates pivotal movement of the operator's control lever into linear movement of control rod 100. A clevis 103 and link 104 connect one end of control rod 100 to the latch lever 102.

The latch pin 106 for connecting slide plate 80 to upper implement support bracket 72 is best illustrated in FIGS. 6–10. Referring to FIG. 10, the latch pin 106 is illustrated in cooperative registry with cam 110. Cam 110 includes a cam surface comprised of a V-shaped portion 11, 112 and adjoining flat portions 117. Latch pin 106 includes a transverse roll pin 107, and in its latched position, roll pin 107 nests within the notch of V-shaped cam surface portion 111, 112. Cam 110 includes spaced apart upright leg portions 113 which are slidably mounted on control rod 100. The latch pin 106 is spring-biased by bracket assembly 114 which is secured to the slide plate 80 by bolts 115. Spring 116 works against transverse pin 108 (FIGS. 6 and 8) which passes through latch pin 106. Thus, the latch pin 106 is spring-biased so that it normally extends through the slide plate opening illustrated in FIGS. 6–9 in a cantilevered fashion to mate within a selected mating opening in the implement support bracket 72.

By connecting the slide plate 80 to various connecting points on the implement support bracket 72, the piston-cylinder 86 is capable of fully laterally shifting the implement while reducing the length and stroke requirements of the piston-cylinder. The stroke of the piston-cylinder 86 may be approximately one-half the lateral shift of the implement, substantially reducing the power requirements and the expense of the piston-cylinder 86.

Spring-biased latch pin 106 passes through the opening in the slide plate 80 to mate with either left-hand opening 118 or right-hand opening 119 in implement support bracket 72. The distance between the openings 118 and 119 is equal to the stroke of piston-cylinder 86. Openings 118 and 119 are provided in the upper implement support bracket 72 so that when the slide plate 80 is latched via latch pin 106 to the implement support bracket 72 and the piston-cylinder 86 is extended or retracted, the slide plate 80 and implement attachment are moved laterally.

The slide plate 80 includes a stop block 130 (FIG. 5) mounted thereon which moves between and abuts stops 128 mounted on the upper implement support bracket 72. Stop block 130 and stops 128 insure proper alignment between the opening in the slide plate 80 and either opening 118 or 119 in the implement support bracket 72. If the piston-cylinder 86 is fully retracted and the implement is centered on the frame assembly, the opening in the slide plate will be aligned with left-hand opening 118 in the implement support bracket 72 thereby permitting the spring-biased latch pin 106 to latch the slide plate to the support bracket in a first latch condition as illustrated in FIG. 5. In this first latched condition, the opening in the slide plate 80 is one-half the distance of the cylinder stroke to the left of the center of the side shift frame assembly (FIG. 5). Actuation of the piston-cylinder will move the implement to the right on the frame assembly and back to center.

When the piston-cylinder 86 is fully extended and the implement attachment is centered on the frame assembly, the opening in the slide plate 80 is aligned with right-hand opening 119 in the implement support bracket 72, and the slide plate 80 may again be latched to the implement support bracket by latch pin 106. In this second latched condition, the opening in the slide plate 80 is one-half the distance of the cylinder stroke to the right of the center of the frame assembly. Actuation of the piston-cylinder under this second latched condition moves the slide plate and attached implement laterally to the left and back to center. Other openings in upper implement support bracket 72 may be provided between the left-hand opening 118 and the right-hand opening 119. By providing openings 118 and 119 in the implement support bracket 72, the slide plate 80 may be latched to the implement in a manner which permits the stroke of the piston-cylinder 86 to be reduced thereby reducing the expense of the piston-cylinder.

The latching mechanism 96 which forms a separate part of the present invention is designed to be accessible from an operator's station regardless of the position of the latch pin 106 or the implement. Cam 110 is slidably movable along control rod 100 between stop washers 124 and 126 which are fixed to control rod 100. The operation of the latching mechanism will be better understood by reference to FIGS. 6–9.

Figure 6:
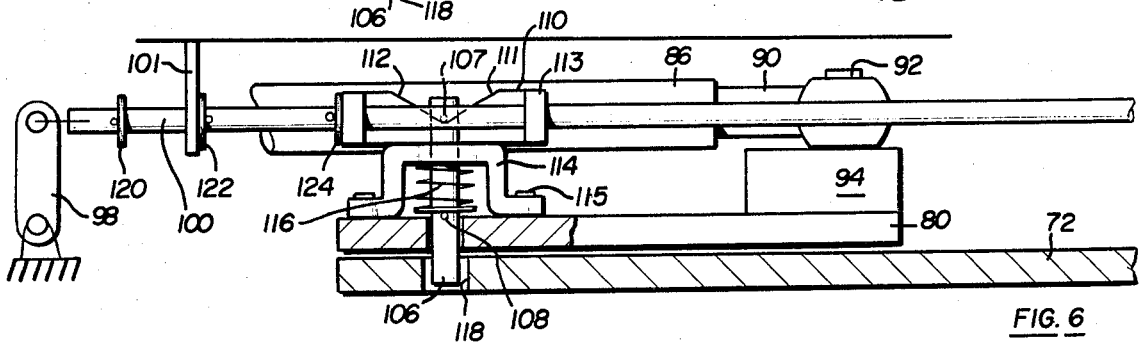
FIG. 6 is a detailed top plan view of the latching mechanism with the latch pin locked into engagement with one of the openings in the implement support bracket.

FIG. 6 illustrates pin 106 and cam 110 in a normal latched condition. Pin 106 is locked within left-hand opening 118 in implement support bracket 72, and this latched condition permits the implement to be powered horizontally from the center of the frame assembly to the right and back to center. During such side shifting, the cam 110 will slide along control rod 100 without changing the relationship of the latching mechanism 96 to the slide plate 80.

Figure 7:
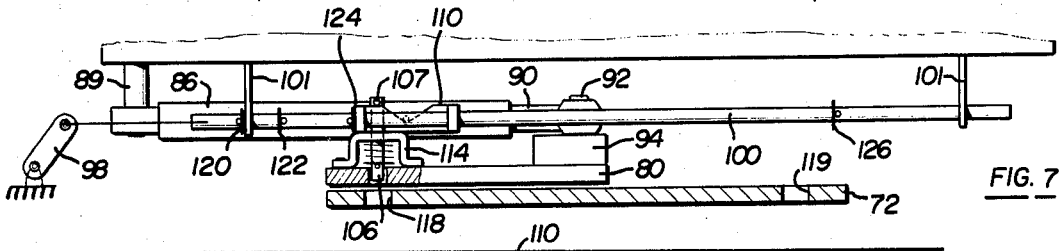
FIG. 7 is a detailed top plan view of the latching mechanism illustrating the latch pin being unlatched from the position illustrated in FIG. 6.

When it is desired to side shift the implement to the left, the latch pin 106 must be in the right-hand opening 119 in the implement support bracket 72. To reposition the latch pin 106, the operator rotates control lever 98 which forces control rod 100 and stop washer 124 against the side of cam 110 as illustrated in FIG. 7. Cam 110 is forced to shift laterally and roll pin 107 slides up inclined ramp 112 and onto the flat portion 117 of the cam surface thereby retracting latch pin 106. Piston-cylinder 86 may be actuated which shifts slide plate 80 laterally to the right.

Figure 8:
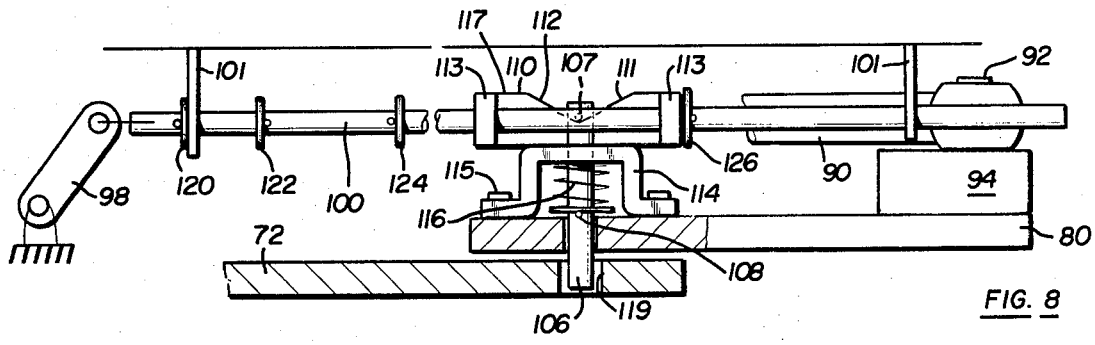
FIG. 8 is a detailed top plan view of the latching mechanism illustrating the latch pin in locking engagement with the other opening in the implement support bracket.

As the retracted pin 106 approaches the right-hand opening 119 in the implement support bracket 72, cam 110 contacts stop washer 126 on control rod 100. Cam 110 will move the control rod 100 laterally until contact between stop washer 120 and bracket 101 is made. Cam 110 is stopped and slide plate 80 continues to shift laterally. This action automatically trips the roll pin 107 and latch pin 106 off the flat portion 117 of the cam surface and thereby permits latch pin 106 to be spring-biased into latching engagement with right-hand opening 119 as illustrated in FIG. 8. When latch pin 106 is in this position, the implement may be side shifted from the center of the frame assembly to the left and back to center.

The latch pin 106 may be unlatched from the position illustrated in FIG. 8 by operator movement of the control lever 98 which forces control rod 100 and stop washer 126 against cam 110 to thereby cause roll-pin 107 to slide up ramp 111 and onto flat 117 of the cam surface. As the mechanism is powered to the left, cam 110 contacts stop washer 124 and stop washer 122 contacts bracket 101 which automatically trips the latch pin 106 off the flat 117 of the cam surface and permits it to drop into the left-hand opening 118. The lateral shifting of control rod 100 which provides the necessary unlatching movement of cam 110 is limited by stops 120 and 122 as illustrated in FIGS. 6–9.

The latching mechanism design provides the advantages of a control lever position 98 accessible to the operator, a positive unlatching mechanism for the latch pin 106, and an automatic trip mechanism for relatching the latch pin 106 which eliminates the possibility of cable, hydraulic hose or other structure getting caught during the side shift function.

It will be apparent to those skilled in the art that the foregoing disclosure is exemplary in nature rather than limiting, the invention being limited only by the appended claims.

We claim:

1. A side shift assembly for a ground working implement slidably mounted on a prime mover comprising:

a frame assembly mounted on said prime mover having laterally extending upper and lower slide rails;

an implement support bracket mounting said ground working implement on one of said slide rails for lateral movement relative to said prime mover;

an intermediate slide plate slidably mounted between said upper and lower slide rails for lateral movement relative to said slide rails;

an extensible and retractable fluid operated piston-cylinder operably connected at one end to said frame assembly and at its other end to said intermediate slide plate;

releasable latching means mounted on said slide plate for selectively connecting said slide plate to said implement support bracket, said support bracket having spaced apart connection portions and said latching means having a releasable connector selectively engageable with said connection portions on said support bracket;

said implement being laterally shiftable relative to said prime mover by said side shift assembly such that when said piston-cylinder is fully retracted and said releasable connector is engaged with one of said connection portions on said support bracket, said implement being substantially centered on said frame assembly and actuation of said piston-cylinder causing said implement to move laterally in a first direction and then back to the center of said frame assembly; and when said piston-cylinder is fully extended and said releasable connector is engaged in another of said connection portions of said support bracket, said implement being substantially centered on said frame assembly and actuation of said piston-cylinder causing said implement to move laterally in a direction opposite to said first direction and then back to the center of said frame assembly.

2. The side shift assembly as defined in claim 1 wherein said releasable connector comprises a latch pin which passes through an aligned opening in said slide plate and said connection portions comprising openings in said implement support bracket, spring-biasing means mounted to said slide plate for extending said latch pin in a cantilevered fashion through said opening in said slide plate and into latching engagement with one of said openings in said support bracket.

3. The side shift assembly as defined in claim 2 wherein said latching means further includes a control rod which is movably mounted on said frame assembly, said control rod being movable laterally by a control lever which is operably connected at one end of said control rod, cam means mounted to said control rod and movable along its longitudinal extent, said cam means being movable between stops mounted to said control rod, said cam means being engaged with a portion of said latch pin, pivotal movement of said control lever causing a first of said stops on said control rod to engage said cam means causing said cam means to shift laterally thereby retracting said latch pin from latching engagement with said implement support bracket opening.

4. The side shift assembly as defined in claim 3 wherein said cam means includes a cam surface comprising a generally V-shaped slide portion and plural flat portions, said latch pin including a roll-pin which engages said cam surface, said roll-pin being in the notch of said V-shaped slide portion when said latch pin is in latching engagement with one of said support bracket openings, and said roll-pin engaging one of said flat portions of said cam surface when said latch pin is retracted from latching engagement with said support bracket opening.

5. A side shift assembly wherein a plurality of ground working implements are selectively and individually slidably mounted on a prime mover comprising:

a frame assembly mounted on said prime mover having laterally extending upper and lower slide rails;

upper and lower implement support brackets being mounted to each of said ground working implements, one of said implements being mounted by its respective support brackets on said slide rails for lateral movement relative to said prime mover;

an intermediate slide plate slidably mounted between said upper and lower slide rails for lateral movement relative to said slide rails;

an extensible and retractable fluid operated piston-cylinder operably connected at one end to said frame assembly and at its other end to said intermediate slide plate;

releasable latching means mounted on said slide plate for selectively connecting said slide plate to the upper support bracket of said one implement;

said implement upper support bracket having spaced apart openings, the distance between said openings being equal to the length of the piston-cylinder stroke, said latching means having a releasable connector selectively engageable with said spaced apart openings in said implement upper support bracket;

said implement being shifted laterally on said frame assembly when said piston-cylinder is actuated and said releasable connector being engageable with one of said spaced apart openings in said upper support bracket; and said implement being shifted laterally from a substantially central position on said frame assembly to a position either to the right or to the left of center depending on the opening being engaged by said releasable connector.

6. The side shift assembly as defined in claim 5 wherein said upper and lower implement support brackets include removable hook means for mounting said implement to said slide rails whereby disconnecting the hook means from one of said support brackets permitting removal of said implement from said frame assembly.

7. The side shift assembly as defined in claim 5 wherein said releasable connector comprises a latch pin which passes through an aligned opening in said slide plate, spring-biasing means mounted to said slide plate for extending said latch pin in a centilevered fashion through said opening in said side plate and into latching engagement with one of said spaced apart openings in said upper implement support bracket.

8. The side shift assembly as defined in claim 7 wherein said releasable latching means further includes a control rod which is movably mounted on said frame assembly, said control rod being movable laterally by a control lever which is operably connected at one end of said control rod, cam means mounted to said control rod and movable along its longitudinal extent, said cam means being movable between stops mounted to said control rod, said cam means being engageable with a portion of said latch pin, pivotal movement of said control lever causing a first of said stops on said control rod to engage said cam means and retract said latch pin from latching engagement with said implement support bracket opening.

9. The side shift assembly as defined in claim 8 wherein said cam means includes a cam surface comprising a generally V-shaped slide portion and plural flat portions, said latch pin including a transverse roll-pin which engages said cam surface, said roll-pin being in the notch of said V-shaped slide portion when said latch pin is in latching engagement with one of said support bracket openings and said roll-pin engaging one of said flat portions when said latch pin is retracted from latching engagement with said support bracket opening.

10. A side shift assembly for a ground working implement slidably mounted on a prime mover comprising:

a frame assembly mounted on said prime mover having laterally extending upper and lower slide rails;

an intermediate slide plate slidably mounted between said upper and lower slide rails for lateral movement relative to said slide rails;

an extensible and retractable fluid operated piston-cylinder operably connected at one end to said frame assembly and at its other end to said intermediate slide plate;

releasable latching means mounted on said slide plate for selectively connecting said slide plate to an implement which is mounted on said slide rails for lateral movement relative to said prime mover, said latching means including a pin which passes through an opening in said slide plate for selective mating engagement within openings in a support bracket of said implement;

said slide plate including a stop block mounted thereon which moves between and abuts stops mounted on said support bracket, said stops and stop block insuring proper alignment between the opening in said slide plate and a selected opening in said implement support bracket; and said opening in said slide plate being substantially one-half the distance of the piston-cylinder stroke from the center of the frame assembly when said piston-cylinder is either fully retracted or fully extended.

11. The side shift assembly as defined in claim 10 including spring-biasing means mounted to said slide plate for extending said pin in a cantilevered fashion through said opening in said slide plate and into latching engagement with one of said openings in said support bracket.

12. The side shift assembly as defined in claim 11 wherein said latching means further includes a control rod which is movably mounted on said frame assembly, said control rod being movable laterally by a control lever which is operably connected at one end of said control rod and accessible to an operator, cam means mounted to said control rod and movable along its longitudinal extent, said cam means being movable between stops mounted to said control rods, said cam means being engaged with a portion of said pin, pivotal movement of said control lever causing a first of said stops on said control rod to engage said cam means and retract said pin from latching engagement with said support bracket opening.

13. The side shift assembly as defined in claim 12 wherein said cam means includes a cam surface comprising a generally V-shaped slide portion and plural flat portions, said pin including a transverse portion which engages said cam surface, said transverse portion being in the notch of said V-shaped slide portion when said pin is in latching engagement with one of said support bracket openings and said transverse portion engaging one of said flat portions on said cam surface when said pin is retracted from latching engagement with said support bracket opening.

* * * * *